US006287072B1

(12) United States Patent
Wasilas

(10) Patent No.: US 6,287,072 B1
(45) Date of Patent: Sep. 11, 2001

(54) PRECISION GRAPPLE

(76) Inventor: James Wasilas, 26979 N. Elm St., Wacunda, IL (US) 60084

( * ) Notice: Subject to any disclaimer, the term of this patent is extended or adjusted under 35 U.S.C. 154(b) by 0 days.

(21) Appl. No.: 09/421,899

(22) Filed: Oct. 21, 1999

Related U.S. Application Data

(60) Provisional application No. 60/132,797, filed on May 6, 1999.

(51) Int. Cl.[7] ..... E02F 3/413

(52) U.S. Cl. ..... 414/729; 37/406; 414/912

(58) Field of Search ..... 414/729, 724, 414/722, 704, 912; 37/403, 406, 903

(56) References Cited

U.S. PATENT DOCUMENTS

| | | | | |
|---|---|---|---|---|
| 3,307,277 | * | 3/1967 | Kondracki | 414/724 X |
| 4,283,866 | | 8/1981 | Ogawa . | |
| 4,285,628 | | 8/1981 | Jankowski . | |
| 4,519,739 | * | 5/1985 | Risch | 414/724 |
| 4,845,867 | * | 7/1989 | Albrecht | 414/722 X |
| 4,896,444 | * | 1/1990 | Sieber et al. | 414/722 X |
| 4,907,356 | | 3/1990 | Labounty . | |
| 5,553,408 | | 9/1996 | Townsend . | |
| 5,639,205 | | 6/1997 | Kaczmarczyk . | |
| 5,678,332 | | 10/1997 | Hawkins . | |
| 5,927,933 | * | 7/1999 | Tucker | 414/729 |

* cited by examiner

*Primary Examiner*—Donald W. Underwood
(74) *Attorney, Agent, or Firm*—Don Moyer

(57) ABSTRACT

The precision grapple—which is removably attachable to a vehicle which has implement fittings to which civil engineering implements are removably attachable—has a forwardly converging, low walled lifting bed so that oddly shaped objects—such as rocks and boulders—can be moved, held, and carried by the grapple, has a forwardly converging tongue which is removably attachable to the lifting bed to extend the lifting bed, and has a prong with two arms spaced to clear a tall object—such as a balled tree—held on the lifting bed by the prong.

6 Claims, 1 Drawing Sheet

PRECISION GRAPPLE

CROSS REFERENCES TO RELATED APPLICATIONS

This application claims benefit of U.S. Provisional Application No. 60/132,797 filed May 6, 1999.

BACKGROUND OF THE INVENTION

The invention is a grapple removably attachable to a vehicle which has implement fittings to which civil engineering implements are removably attachable, the grapple having a low walled, forwardly converging lifting bed.

Workers needing to move, lift, and carry oddly shaped objects—such as a bolder—in existing civil engineering implements which can be attached to a vehicle have a long outstanding problem. The existing implements have dimensions and configurations which do not match the dimensions and forms of oddly shaped objects. Thus it is difficult to precisely move an oddly shaped object without disturbing adjacent objects, it is difficult to lift an oddly shaped object without disturbing adjacent objects, and oddly shaped objects can move around in the implement when being carried. The invention shown here is based on the discovery that a grapple with a low walled, forwardly converging lifting bed solves this long outstanding problem.

Various grapple configurations are shown in prior art, for example by Ogawa in U.S. Pat. No. 4,283,866, by Jankowski in U.S. Pat. No. 4,285,628, by Labounty in U.S. Pat. No. 4,907,356, by Towensend in U.S. Pat. No. 5,553,408, by Kaczmarczyk in U.S. Pat. No. 5,639,205, and by Hawkins in U.S. Pat. No. 5,678,332. None of these are adapted to move, lift, and carry oddly shaped objects with precision. The precision grapple shown here is not suggested in any prior art or any combinations of prior art.

SUMMARY OF THE INVENTION

One form of this invention—which, in use, is removably attached to a vehicle, the vehicle having implement fittings to which civil engineering implements are removably attachable—comprises a low walled, forwardly converging lifting bed and a prong which is attached to the lifting bed and which is moved relative to the lifting bed by an actuator attached between the prong and the lifting bed.

Alternate forms and objects of the invention will be comprehended in the drawings and description, which will make other alternate forms and objects obvious hereafter to persons skilled in the art.

DESCRIPTION OF THE PREFERRED EMBODIMENTS

Figure 3:
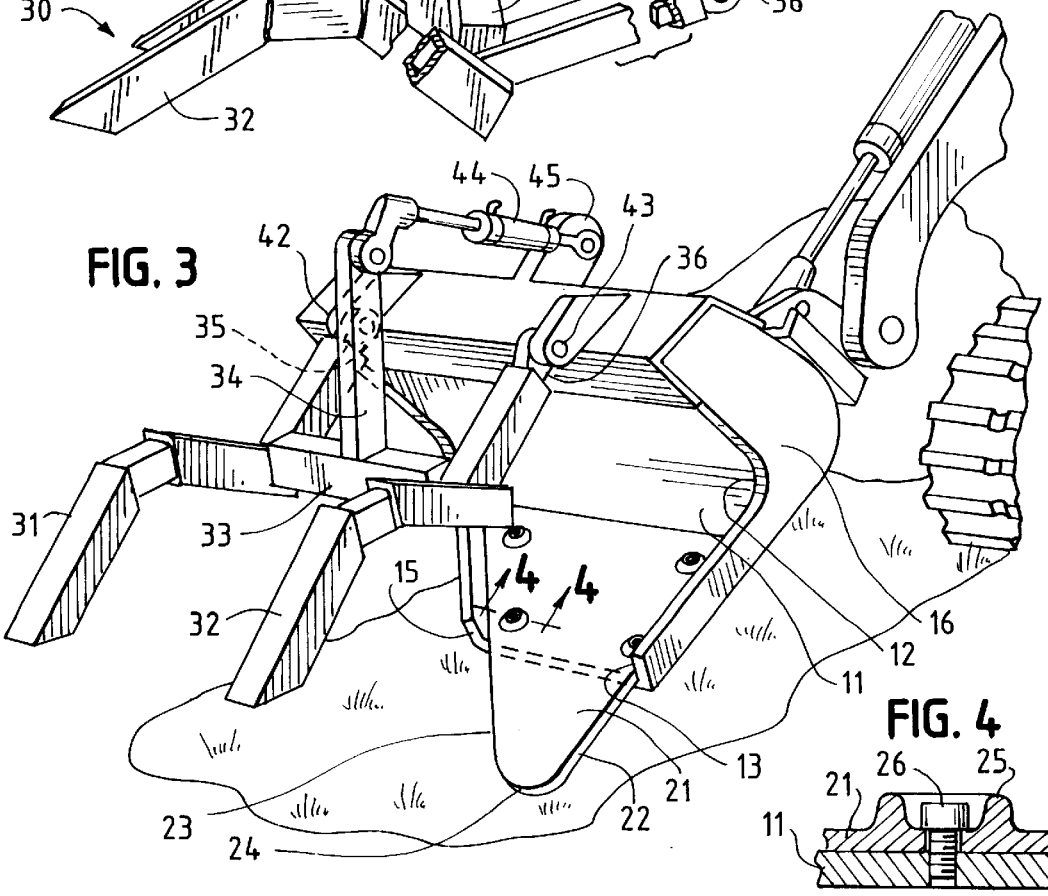
FIG. 3 shows elements of the precision grapple.

The key feature—seen best in FIG. 3—of the precision grapple 10 is a forwardly converging, low walled lifting bed. The lifting bed has a base 11 which is leftwardly terminated by a low left wall which is upstanding from the base and which extends from a left rear-most portion 12 to a left front-most portion 13. The base 11 is rightwardly terminated by a low right wall which is upstanding from the base and which extends from a right rear-most portion 14 to a right front-most portion 15. The base is forwardly extended by a tongue 21 which has a left edge 22, a right edge 23, and a front 24 and is removably attached to the base.

Figure 1:
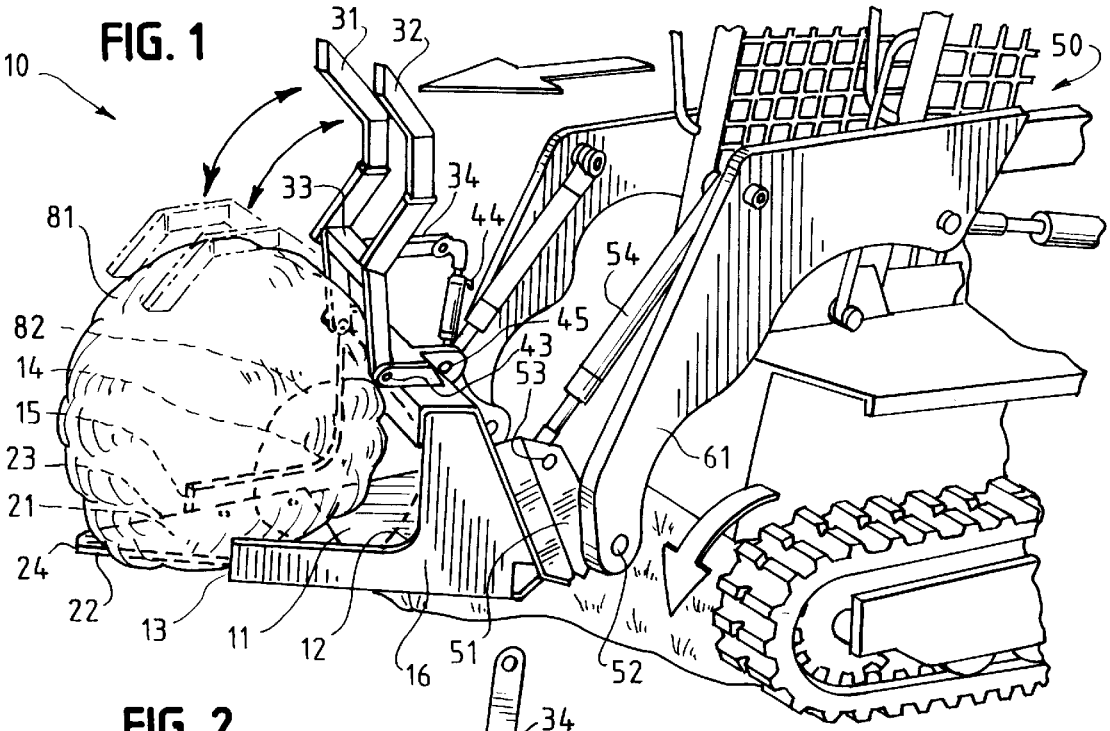
FIG. 1 shows the precision grapple in use.

The low left wall and the low right wall, and the tongue left edge and right edge, converge forwardly so that when a large spheroidal object such as a boulder is lifted by the lifting bed, the object has stable three point support from the low left wall, the base, and the low right wall. A very large object such as the boulder 81, and a less large object such as rock 82, can be stably supported as shown in FIG. 1.

Figure 2:
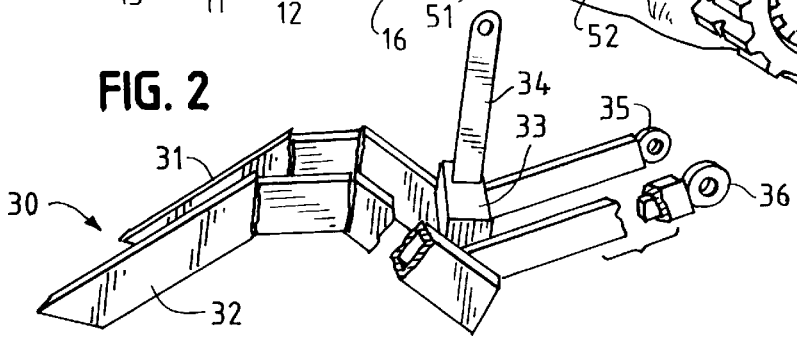
FIG. 2 shows the grapple prong detached.

A prong—30 in FIG. 2 is the preferred form—is attached to the lifting bed. For many purposes, such as moving boulders, a prong with only one arm could be used. The preferred prong has a right arm 31 and a left arm 32, has a cross member 33 connecting the two arms, and has a central attachment stud 34, a right attachment stud 35, and a left attachment stud 36 extending from the cross member 33. The arms extend well beyond the cross member. Thus the arms and the cross member are spaced to clear a tall object, such as a balled tree, held on the base by the prong.

The base 11 is rearwardly terminated by a box 16 which is open forwardly. The box has a right attachment ear 42 and a left attachment ear 43 to which respectively the prong right attachment stud 35 and left attachment stud 36 are attached. A prong actuator 44 is attached between the prong central attachment stud 34 and a box central attachment ear 45. The box also has a left attachment plate 51 with a first attachment point 52 where the box is attached to an implement fitting 61 of a vehicle 50 to which civil engineering implements are removably attachable. A box actuator 54 is attached between a second attachment point 53 and the implement fitting 61. There are right side equivalents of 51, 52, 53, 54, and 61 which are not fully visible in the drawings.

Figure 4:
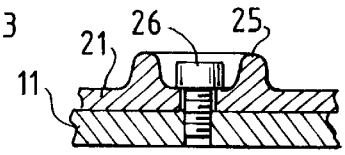
FIG. 4 shows the tongue to base attachment.

An attachment of the tongue 21 to the base 11 is shown in FIG. 4. Here a bolt 26 passes through the tongue and is threaded into the base. A protrusion 25 from the tongue protects the head of the bolt. Other ways to removably attach the tongue to the base known in the art and hereafter obvious can be used. Similarly, other ways to attach the prong to the box and to attach the box to the civil engineering implement fittings of a vehicle known in the art and hereafter obvious can be used. The box can have any form which provides for these attachments and provides adequate structural strength.

The prong can have many forms. Also, many variations of the form of the low walls from that shown can be adopted so long as the walls are of a height so that three points of support can be provided by the walls and the base for the largest spheroidal objects to be lifted. And, other forms for the base, and the tongue extending the base, can be adopted so long as the low left wall and the low right wall, and the tongue left edge and right edge, converge forwardly so that when a large object such as a boulder is lifted by the lifting bed, the object has stable three point support from the low left wall, the base, and the low right wall, and a less large object can also be stably supported, as shown in FIG. 1.

Other equivalent forms for the lifting bed and the prong and other equivalent connections removably attaching the prong to the lifting bed and attaching the lifting bed to a vehicle will be obvious hereafter to persons skilled in the art. Therefore this invention is not limited to the particular examples shown and described here.

I claim:

1. In combination with a vehicle, the vehicle having implement fittings to which civil engineering implements are removably attachable, a precision grapple comprising:

a base, a box, the box rearwardly terminating the base, the box being removably attached to the implement fittings of the vehicle;

a low left wall, the low left wall leftwardly terminating the base and the low left wall being upstanding from the base;

a low right wall, the low right wall rightwardly terminating the base and the low right wall being upstanding from the base, the low right wall and the low left wall being forwardly converging;

a prong, the prong being removably attached to the box; and an actuator, the actuator being removably attached between the prong and the box to move the prong relative to the base.

2. The device of claim 1 further comprising a tongue, the tongue having a left edge, a right edge, and a front portion, the left edge and the right edge being forwardly converging, the tongue being removably attached to the base, and the tongue extending the base forwardly.

3. The device of claim 1 wherein the prong has a left arm, a right arm, and a cross member attached between the left arm and the right arm, with the left arm, the right arm, and the cross member being spaced to clear a tall object held on the base by the prong.

4. In combination with a vehicle, the vehicle having implement fittings to which civil engineering implements are removably attachable, a precision grapple comprising:

a base, a box, the box rearwardly terminating the base, the box being removably attached to the implement fittings of the vehicle;

a low left wall, the low left wall leftwardly terminating the base and the low left wall being upstanding from the base;

a low right wall, the low right wall rightwardly terminating the base and the low right wall being upstanding from the base, the low right wall and the low left wall being forwardly converging;

a prong, the prong being removably attached to the box;

an actuator, the actuator being removably attached between the prong and the box to move the prong relative to the base; and a tongue, the tongue having a left edge, a right edge, and a front portion, the left edge and the right edge being forwardly converging, the tongue being removably attached to the base, and the tongue extending the base forwardly.

5. The device of claim 4 wherein the prong has a left arm, a right arm, and a cross member attached between the left arm and the right arm, with the left arm, the right arm, and the cross member being spaced to clear a tall object held on the base by the prong.

6. In combination with a vehicle, the vehicle having implement fittings to which civil engineering implements are removably attachable, a precision grapple comprising: a base, a box, the box rearwardly terminating the base, the box being removably attached to the implement fittings of the vehicle;

a low left wall, the low left wall leftwardly terminating the base and the low left wall being upstanding from the base;

a low right wall, the low right wall rightwardly terminating the base and the low right wall being upstanding from the base, the low right wall and the low left wall being forwardly converging;

a prong, the prong being removably attached to the box; the prong having a left arm, a right arm, and a cross member attached between the left arm and the right arm, with the left arm, the right arm, and the cross member being spaced to clear a tall object held on the base by the prong;

an actuator, the actuator being removably attached between the prong and the box to move the prong relative to the base; and a tongue, the tongue having a left edge, a right edge, and a front portion, the left edge and the right edge being forwardly converging, the tongue being removably attached to the base, and the tongue extending the base forwardly.

* * * * *